US006832875B2

(12) United States Patent
Bliault et al.

(10) Patent No.: US 6,832,875 B2
(45) Date of Patent: Dec. 21, 2004

(54) FLOATING PLANT FOR LIQUEFYING NATURAL GAS

(75) Inventors: Alan Edgar John Bliault, The Hague (NL); Casper Krijno Groothuis, The Hague (NL); Koen Willem De Leeuw, Amsterdam (NL); Duncan Peter Michael Reijnen, The Hague (NL); Clemens Arnoldus Cornelis Van Der Valk, The Hague (NL)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 10/363,889

(22) PCT Filed: Sep. 11, 2001

(86) PCT No.: PCT/EP01/10561

§ 371 (c)(1),
(2), (4) Date: Mar. 10, 2003

(87) PCT Pub. No.: WO02/21060

PCT Pub. Date: Mar. 14, 2002

(65) Prior Publication Data

US 2003/0185631 A1 Oct. 2, 2003

(30) Foreign Application Priority Data

Sep. 11, 2000 (EP) ..... 00307821

(51) Int. Cl.[7] ..... E02B 1/00
(52) U.S. Cl. ..... 405/195.1; 405/203; 114/264
(58) Field of Search ..... 405/195.1, 210, 405/203, 207; 114/264, 74 R, 74 A; 62/240, 53.2

(56) References Cited

U.S. PATENT DOCUMENTS

| | | | | | |
|---|---|---|---|---|---|
| 4,041,721 | A | * | 8/1977 | Kniel | 62/53.2 |
| 5,878,814 | A | * | 3/1999 | Breivik et al. | 166/267 |
| 5,971,039 | A | * | 10/1999 | Webb | 141/98 |
| 6,089,022 | A | * | 7/2000 | Zednik et al. | 60/641.7 |
| 6,250,244 | B1 | * | 6/2001 | Dubar et al. | 114/264 |
| 6,598,408 | B1 | * | 7/2003 | Nierenberg | 62/53.2 |

FOREIGN PATENT DOCUMENTS

| | | | | |
|---|---|---|---|---|
| EP | 0 051 571 | | 5/1982 | F04F/1/18 |
| GB | 360 140 | | 11/1931 | |
| GB | 2 160 925 | | 1/1986 | F04D/9/02 |
| JP | 62 149591 | | 7/1987 | B63B/13/00 |
| JP | 03209098 A | * | 9/1991 | F17C/9/02 |
| JP | 05032194 A | * | 2/1993 | B63B/25/08 |

* cited by examiner

*Primary Examiner*—Jong-Suk (James) Lee
*Assistant Examiner*—Lisa M Saldano

(57) ABSTRACT

A floating plant for liquefying natural gas having a barge provided with a liquefaction plant, member for receiving natural gas and with member for storing and discharging liquefied natural gas. The liquefaction plant involves a heat exchange in which heat is removed when liquefying natural gas is transferred to water. The barge is further provided with a receptacle; an open-ended water intake conduit having an inlet; a connecting conduit extending from the outlet of the water intake conduit to the receptacle; a pump for transporting water from the receptacle to the heat exchanger and a water discharge system for discharging water removed from the heat exchanger. The connecting conduit has the shape of an inverted "U" of which the top is located above the receptacle.

12 Claims, 1 Drawing Sheet

FLOATING PLANT FOR LIQUEFYING NATURAL GAS

FIELD OF THE INVENTION

The present invention relates to a floating plant for liquefying natural gas, which comprises a barge provided with a liquefaction plant, means for receiving natural gas and with means for storing and discharging liquefied natural gas. The liquefaction plant includes a heat exchanger in which heat is removed when liquefying natural gas is transferred to water.

SUMMARY OF THE INVENTION

It is an object of the present invention to provide a simple system for transporting water to and from the heat exchanger of the liquefaction plant.

To this end the floating plant for liquefying natural gas according to the present invention comprises a barge provided with a liquefaction plant, means for receiving natural gas and with means for storing and discharging liquefied natural gas, which liquefaction plant includes a heat exchanger in which heat removed when liquefying natural gas is transferred to water, which barge is further provided with a receptacle arranged in the barge, an open-ended water intake conduit suspended from the barge having an inlet that is arranged below the receptacle, a connecting conduit extending from the outlet of the water intake conduit to the inlet of the receptacle, a pump for transporting water from the receptacle via a supply conduit to the heat exchanger and a water discharge system for discharging water from the heat exchanger, wherein the connecting conduit has the shape of an inverted 'U' of which the top is located above the receptacle.

BRIEF DESCRIPTION OF THE DRAWINGS

The invention will now be described in more detail with reference to the accompanying drawing, which shows a partial longitudinal section of the floating plant for liquefying natural gas according to the present invention.

DETAILED DESCRIPTION OF THE INVENTION

Figure 1:
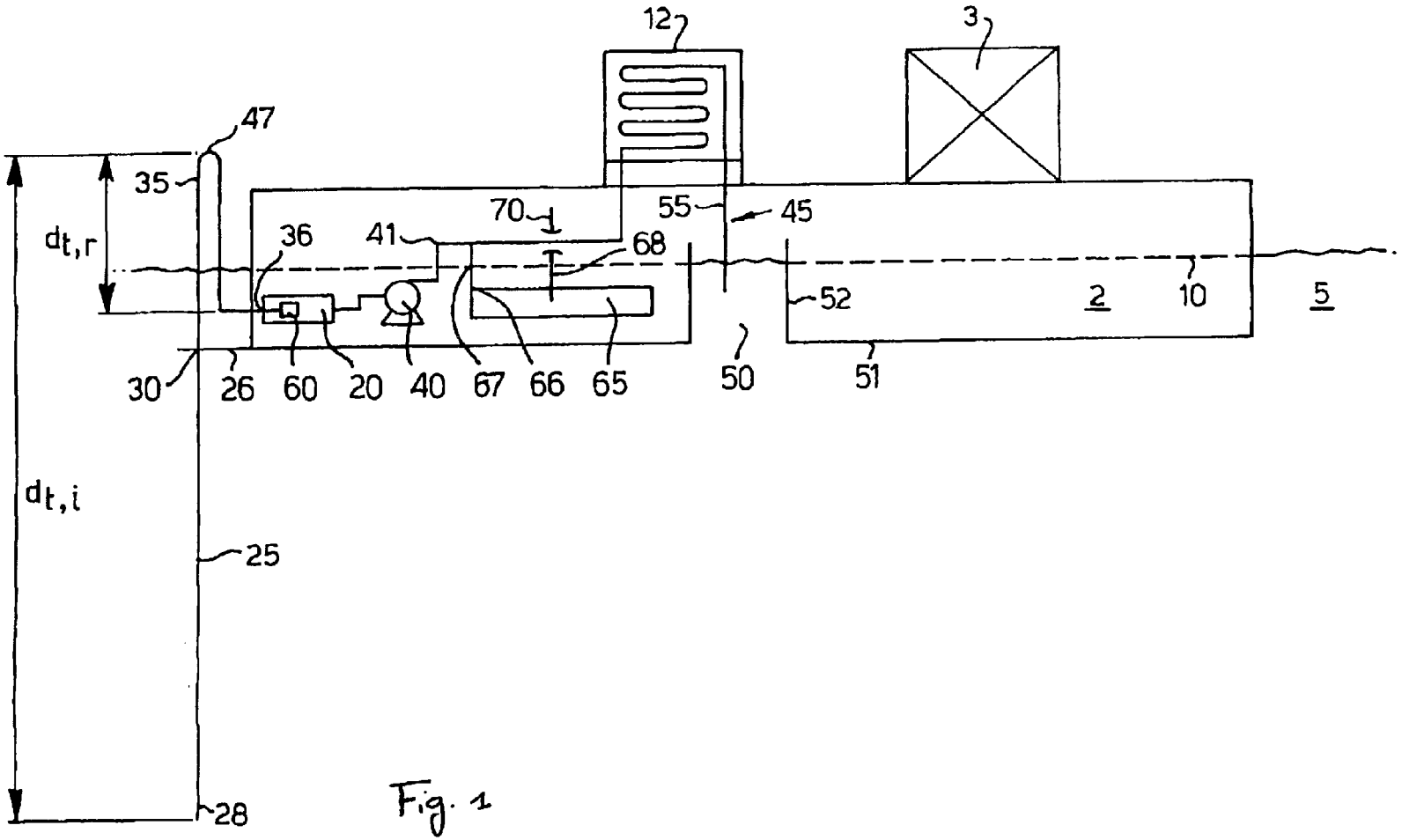

The floating plant for liquefying natural gas comprises a barge 2 provided with a liquefaction plant 3, with means for receiving natural gas (not shown) and with means for storing and discharging liquefied natural gas (not shown). The barge 2 is floating in water 5, and the dashed line 10 represents the water line.

The liquefaction plant 3 includes a heat exchanger 12 in which heat removed when liquefying natural gas is transferred to water. It is well known in the art that natural gas is liquefied by indirect heat exchange with evaporating refrigerant in a main heat exchanger. The refrigerant passes through a circuit that includes compression, liquefying and evaporating in the main heat exchanger. The refrigerant that is evaporating in the main heat exchanger is liquefied by means of indirect heat exchange with an evaporating auxiliary refrigerant. The auxiliary refrigerant also passes through a circuit that includes compression, liquefying and evaporating. In order to liquefy the auxiliary refrigerant, it is cooled by means of indirect heat exchange with water in the heat exchanger 12.

For the sake of clarity no details of the liquefaction plant 3 are shown in the drawing.

Now the path of the cooling water is discussed in detail.

The barge 2 is further provided with a receptacle 20 arranged in the barge 2 below the water line 10, an open-ended water intake conduit 25 suspended from a platform 26 attached to the barge 2. The water intake conduit 25 has an inlet 28 that is arranged below the receptacle 20 and an outlet 30 at its upper end, and a connecting conduit 35 extending from the outlet 30 of the water intake conduit 25 to the inlet 36 of the receptacle 20. The barge 2 is further provided with a pump 40 for transporting water from the receptacle 20 via a supply conduit 41 to the heat exchanger 12 and a water discharge system 45 for discharging water removed from the heat exchanger 12.

The connecting conduit 35 has the shape of an inverted 'U' of which the top 47 is located above the water line 10.

During normal operation, natural gas is supplied to the liquefaction plant 3 where it is liquefied. The liquefied natural gas is stored in the barge 2 and it can be discharged into a vessel suitable for transporting the liquefied natural gas to shore. Auxiliary refrigerant is cooled in the heat exchanger 12 by indirect heat exchange with water.

The water is supplied to the heat exchanger 12 in the following way. First the water is supplied via the open-ended water intake conduit 25 and the connecting conduit 35 to the receptacle 20, and from there it is pumped to the heat exchanger 12. From the heat exchanger 12 the water is discharged through the water discharge system 45.

In order to start the water flow a siphon is created. This can be done by filling the receptacle 20 with water, and sucking water into the water intake conduit 25 and the connecting conduit 35 by applying a low pressure, $P_t$ ($N/m^2$), preferably vacuum to the top 47 of the connecting conduit 35. The pressure in the water intake conduit 25 at its inlet end is $p_t+\rho g d_{t,i}$ and the pressure at the inlet 36 of the receptacle 20 is $p_t+\rho g d_{t,r}$, wherein $\rho$ is the density of water ($kg/m^3$), g is the acceleration of gravity ($m/s^2$), $d_{t,i}$ is the distance from the top 47 to the inlet 28 (m) and $d_{t,r}$ is the distance from the top 47 to the inlet 36 of the receptacle 20 (m). To ensure that the water keeps flowing, $d_{t,i}$ has to be larger than $d_{t,r}$. Suitably $d_{t,i}$ is between 50 and 100 times $d_{t,r}$. In addition, the distance from the top 47 to the water line 10 must be so selected that the pressure at the top, $p_t=p_0-\rho g d_{t,r}\geqq 0$, wherein $p_0$ is atmospheric pressure.

The outlet of the discharge conduit 55 may suitably open at the side of the barge 2.

Suitably, the water discharge system 45 comprises a passage 50 through the bottom 51 of the barge 2, a chimney 52 extending from the passage 50 to a level above the water line 10 and a discharge conduit 55 extending from the outlet of heat exchanger 12 into the chimney 52. The outlet of the discharge conduit 55 opens below the water line 10.

Suitably, the receptacle 20 is provided with a filter system 60 so arranged that during normal operation water passes through the filter system 60 to the pump 40. The filter system comprises filter equipment suitable for continuously clarifying water, such as a rotating drum or a cyclone.

In order to be able to lower the pressure in the top 47 of the connecting conduit 35, at or near its top 47 the connecting conduit 35 is provided with a passage (not shown) provided with a flange, to which flange a conduit (not shown) provided with a valve is removably connected. A vacuum pump can be connected to the open end of the conduit. Moreover, by allowing ambient air to enter the conduit, the flow of water can be stopped. In addition, when the conduit is removed, means for cleaning the intake conduit 25 can be lowered through the passage.

Suitably, the barge 2 further comprises a ballast tank 65, wherein the ballast tank 65 has an inlet 66 that is connected to the supply conduit 41 by supply conduit 67 and a discharge 68 that is connected to an ejector 70 in the supply conduit 41.

The cooling requirements of the liquefaction plant may require more than one heat exchanger 12. The heat exchangers may be arranged in series or in parallel, or in a combination of series and parallel. Each of these heat exchangers may have its own discharge conduit 55, or there may be a single discharge conduit for two or more heat exchangers.

The amount of water that is needed for cooling may require more than one water intake conduit 25. Suitably the number of water intake conduits is in the range of from 6 to 8. The water intake conduits are suitably provided with means to suppress vibrations due to the water flowing around the outer surfaces of the conduits.

The barge 2 may contain more than one ballast tank 65, and each ballast tank may have its own supply conduit 67 and discharge 68, or there is a supply conduit and a discharge for several ballast tanks.

What is claimed is:

1. A floating plant for liquefying natural gas comprising a barge provided with a liquefaction plant, means for receiving natural gas and with means for storing and discharging liquefied natural gas, which liquefaction plant includes a heat exchanger in which heat removed when liquefying natural gas is transferred to water, which barge is further provided with a receptacle, an open-ended water intake conduit suspended from the barge having an inlet that is arranged below the receptacle, a connecting conduit extending from an outlet of the water intake conduit to the inlet of the receptacle, a pump for transporting water from the receptacle via a supply conduit to the heat exchanger and a water discharge system for discharging water removed from the heat exchanger, wherein the connecting conduit has an inverted U-shape of which the top is located above the receptacle.

2. The barge according to claim 1, wherein the water discharge system comprises a passage through the bottom of the barge, a chimney extending from the passage to a level above the water line and a discharge conduit extending from an outlet of heat exchanger into the chimney, wherein an outlet of the discharge conduit opens below the water line.

3. The barge according to claim 2, wherein the receptacle is provided with a filter system so arranged that during normal operation water passes through the filter system to the pump.

4. The barge according to claim 3, further comprising a ballast tank, wherein each ballast tank has an inlet that is connected to the supply conduit and a discharge that is connected to an ejector in the supply conduit.

5. The barge according to claim 2, wherein at or near its top the connecting conduit is provided with a passage provided with a flange, to which flange a conduit provided with a valve is removably connected.

6. The barge according to claim 2, further comprising a ballast tank, wherein each ballast tank has an inlet that is connected to the supply conduit and a discharge that is connected to an ejector in the supply conduit.

7. The barge according to claim 1, wherein the receptacle is provided with a filter system so arranged that during normal operation water passes through the filter system to the pump.

8. The barge according to claim 7, wherein at or near its top the connecting conduit is provided with a passage provided with a flange, to which flange a conduit provided with a valve is removably connected.

9. The barge according to claim 7, further comprising a ballast tank, wherein each ballast tank has an inlet that is connected to the supply conduit and a discharge that is connected to an ejector in the supply conduit.

10. The barge according to claim 1, wherein at or near its top the connecting conduit is provided with a passage provided with a flange, to which flange a conduit provided with a valve is removably connected.

11. The barge according to claim 10, further comprising a ballast tank, wherein each ballast tank has an inlet that is connected to the supply conduit and a discharge that is connected to an ejector in the supply conduit.

12. The barge according to claim 1, further comprising a ballast tank, wherein each ballast tank has an inlet that is connected to the supply conduit and a discharge that is connected to an ejector in the supply conduit.

* * * * *